US005192011A

United States Patent [19]

Fuchs

[11] Patent Number: 5,192,011

[45] Date of Patent: Mar. 9, 1993

[54] DEVICE FOR SEPARATING BLANKS FOR PACKAGES FROM A SHEET OF BLANKS

[75] Inventor: Werner Fuchs, Lausanne, Switzerland

[73] Assignee: Bobst SA, Switzerland

[21] Appl. No.: 683,075

[22] Filed: Apr. 10, 1991

[30] Foreign Application Priority Data

Apr. 10, 1990 [CH] Switzerland ..... 01220/90

[51] Int. Cl.[5] ..... B26F 3/02

[52] U.S. Cl. ..... 225/97; 83/620; 83/687; 83/696; 83/698; 225/103; 493/373

[58] Field of Search ..... 83/620, 698, 699, 700, 83/687, 691, 696; 225/97, 103; 493/373

[56] References Cited

U.S. PATENT DOCUMENTS

| | | | |
|---|---|---|---|
| 2,313,801 | 3/1943 | Carll | 83/691 |
| 2,413,999 | 1/1947 | Shaner . | |
| 3,373,643 | 3/1968 | Spengler | 83/620 |
| 3,529,506 | 9/1970 | Malm et al. | 83/698 |
| 3,739,676 | 6/1973 | Gerdin | 83/698 |
| 3,759,130 | 9/1973 | Patterson | 83/698 X |
| 4,175,686 | 11/1979 | Lang | 225/97 |
| 4,250,786 | 2/1981 | Bleich | 83/691 |
| 4,371,369 | 2/1983 | Wright, III | 493/373 |

FOREIGN PATENT DOCUMENTS 3235005 3/1984 Fed. Rep. of Germany .

*Primary Examiner*—Frank T. Yost
*Assistant Examiner*—Eugenia A. Jones
*Attorney, Agent, or Firm*—Hill, Van Santen, Steadman & Simpson

[57] ABSTRACT

An upper tool of a blank separating station, which is operated within a machine for producing blanks for packages in sheet material is characterized by the upper tool consisting of a rectangular board provided with a pattern of openings. A lower surface of the board bears a large number of punches which are mounted on the board by a self-locking pin arrangement that extends through one of the apertures in the board.

15 Claims, 9 Drawing Sheets

DEVICE FOR SEPARATING BLANKS FOR PACKAGES FROM A SHEET OF BLANKS

BACKGROUND OF THE INVENTION

The present invention is concerned with a device designed for separating blanks in a machine which converts sheets or plate workpieces into blanks for forming packages.

The production of packages includes three successive stages. The first stage is printing a large number of motifs or images on a sheet with each motif or image corresponding to a single package. The second stage is a die-cutting of the sheet into blanks, with each blank being provided with a single printed motif. The third stage is folding and gluing each of the blanks in order to have it transformed into a flat-folded collapsed package, which can be later erected to receive the contents.

After die-cutting, all blanks contained in a sheet are still held together by small linking points, which correspond to very small non-cutting nicks which are provided in the cutting rules of the die-cutting press. This allows the die-cut sheet to be carried by means of gripper bars, which are mounted on a pair of chains, between the platens of the die-cutting press to subsequent stations for stripping of waste bits consisting of the sheet areas between various blanks, which waste areas are to be removed from the final package, as well as to a delivery station for the sheets.

Depending on the requirements, there should be a possibility in the delivery station of providing a build-up pile of sheets, with each sheet consisting of all the blanks held together by the linking points. Another possiblity is to simultaneously build up several piles of blanks which were previously separated from one another by breaking the linking points in the preceding station called a "blank separating station".

With the present state of the art, the blank separating station is equipped with an upper movable tool and a lower fixed tool. The upper movable tool consists of an assembly of punches or blocks and the lower tool is of a matrix with apertures corresponding to the size of each of the blanks. The upper movable punches will push the blanks through these apertures of the lower matrix, thereby causing the breaking of the various linking points existing between the blanks and also to remove lateral and peripheral sheet waste. Thus, the separating tools are adapted to the configuration and location of the blanks in a sheet and for each new run of sheets to be processed a new separating tool is required. As a rule, the punches are aligned with regard to the cutting lines of the press and fitted on a base plate of the upper movable tool frame of the blank separating station. Underneath and opposite each punch, an aperture or a corresponding mesh of the lower matrix consists of small bars. These small bars are arranged in an overlapping fashion with a view of having them form a grid or matrix which meshes with the approximate dimensions of the blanks to be separated.

To avoid the necessity of making new blank separating tools for every new run of sheets, it has been proposed in U.S. Pat. No. 4,175,686, whose disclosure is incorporated herewith by reference thereto and which is based on the Swiss Application which was issued as Swiss Patent No. 617,886, to fit the punches adjustably in a horizontal direction along bars which are fitted on a vertically movable frame, with every punch having the shape of a block connected to its neighboring block by devices inserted into one another. The lower matrix consists of adjustable crossbars which are shiftable so as to form a grid with meshes and apertures adjusted, as required, to the size of the blanks.

SUMMARY OF THE INVENTION

The present invention has an object to enable the realization of a blank separating device which has none of the above-mentioned drawbacks and, moreover, allows a savings in time when making up the upper matrix by using standard elements adapted to the configuration of the blank. In addition, means are provided on the tool for the easy mounting of a specific punch for the sheet front waste.

To accomplish these goals, the present invention is directed to an improvement for a device for separating blanks in a machine processing sheets into blanks for packages, which machine includes an upper vertical movable tool provided with several punches with adjustable positions and dimensions and a lower fixed tool provided with several apertures, also with adjustable positions and dimensions, the punches being constructed to push the blanks through the apertures. The improvements are that the upper tool comprises a board or plate with a pattern of holes, each punch being provided with quick-locking means for pressing an upper surface under elastic load against a lower surface of the board or plate, said quick-locking means having a first end engageable with the punch and a second end is positioned within a hole in the board.

Other advantages and features of the invention will be readily apparent from the following description of the preferred embodiments, the drawings and claims.

DESCRIPTION OF THE PREFERRED EMBODIMENTS

Figure 1A:
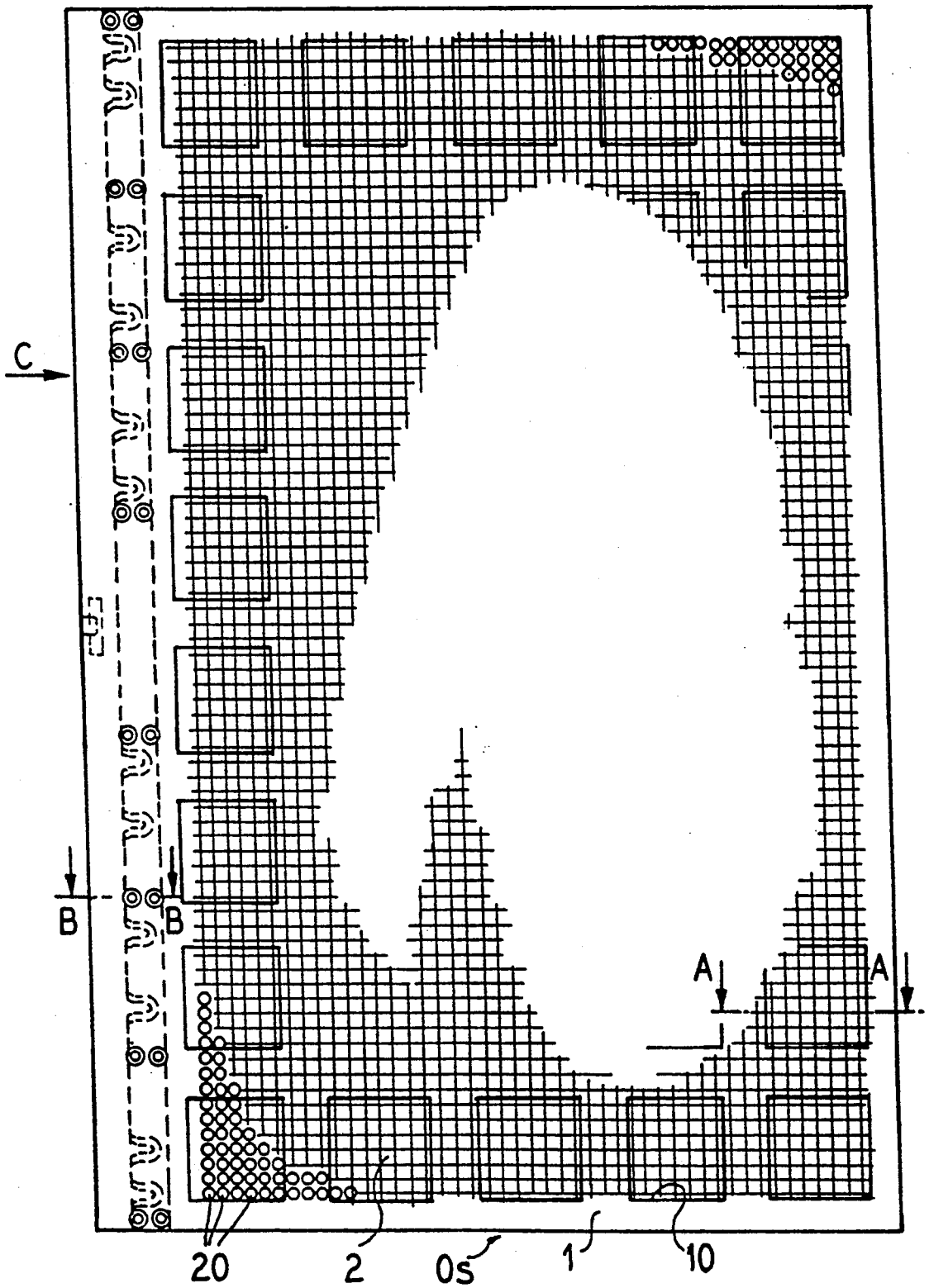
FIG. 1A is a top plan view of an upper separating tool according to the present invention.
Figure 1B:
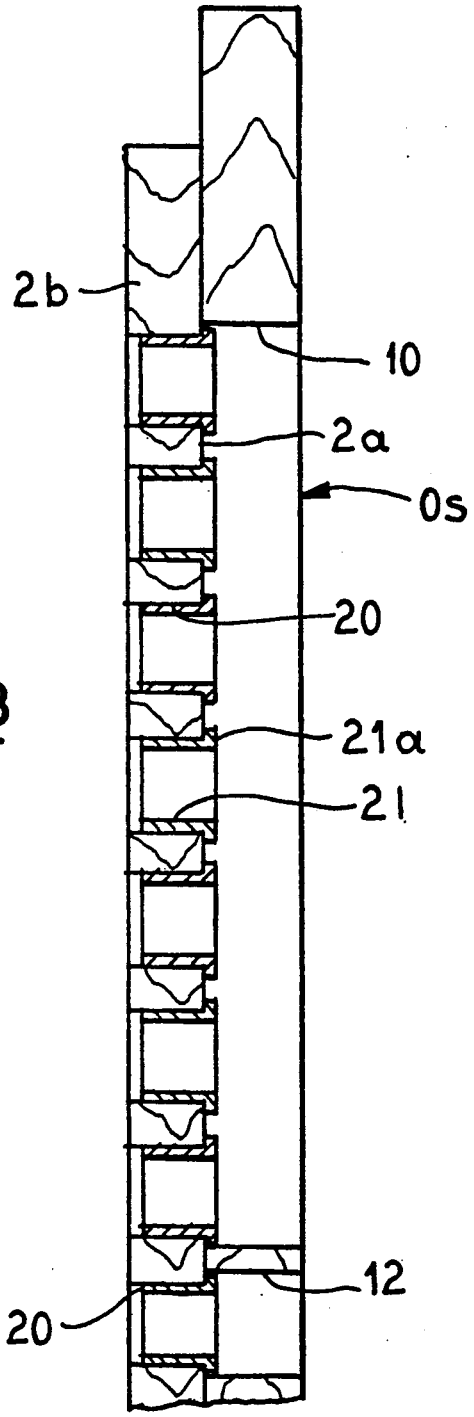
FIG. 1B is a partial cross sectional view taken along the lines A—A of FIG. 1A.

The principles of the present invention are particularly useful when incorporated in a movable upper blank separating tool, generally indicated at Os in FIG. 1A. The separating tool Os, as illustrated in FIGS. 1A and 1B, includes an upper plate member or plate 1 and a lower plate or plate member 2, which are assembled together and centered horizontally relative to one another. The upper plate 1, which may be a wooden board, has the function to increase the rigidity of the tool Os and to allow the fitting of the tool within a movable frame of a blank separating station. The lower plate 2 is used as a support for the blank separating punches P1 (FIG. 2A) or P2 (FIG. 3A). Both plates 1 and 2 are assembled by gluing or other appropriate processes. In addition to wood, the plates may be aluminum, synthetic materials or other light materials.

As illustrated in FIG. 1B, the lower plate 2 has a plurality of holes, such as 20, made by, for example, a laser, which form a pattern of rows and columns (see FIG. 1A). Each hole 20, as illustrated in FIG. 1B, contains a bushing 21 which may be of either a metal or plastic material and has a length which is approximately equal to the thickness of the plate 2. Every bushing 21 has a flange 21*a* on one end that forms a stop which engages an upper surface 2*a* of the plate 2. As illustrated in FIG. 1A, the upper plate 1 also has a pattern of rectangular apertures 10 which are aligned crosswise and lengthwise, with each rectangular aperture 10 overlying a plurality of the holes 20, such as 49 holes. The upper plate 1 is also provided with holes 12 (FIG. 1B) in the portions between the apertures 10 which are aligned with a corresponding hole 20 of the plate 2.

Figure 2A:
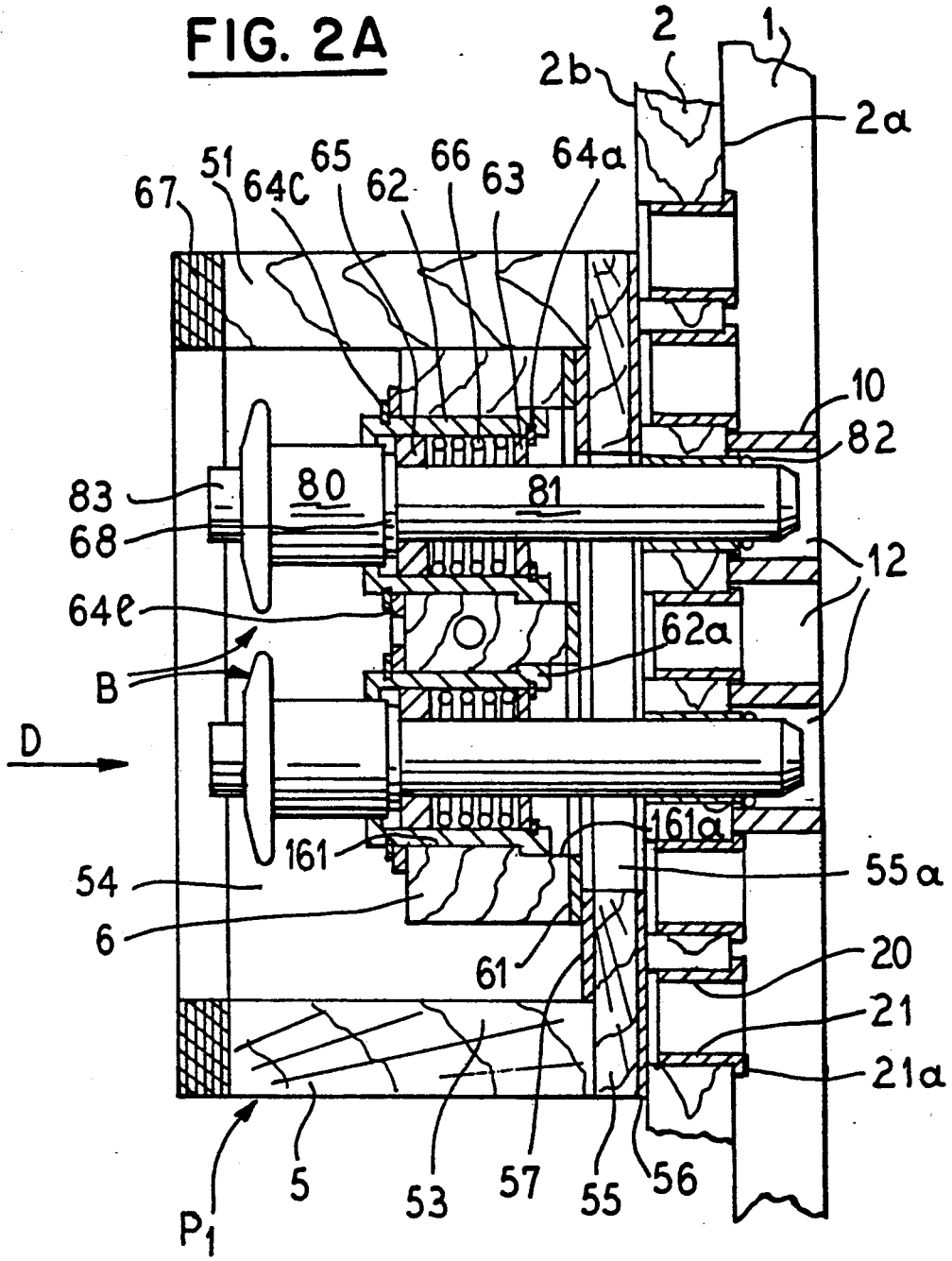
FIG. 2A is a partial cross sectional view illustrating a fastening of a blank separating punch on the tool.
Figure 2B:
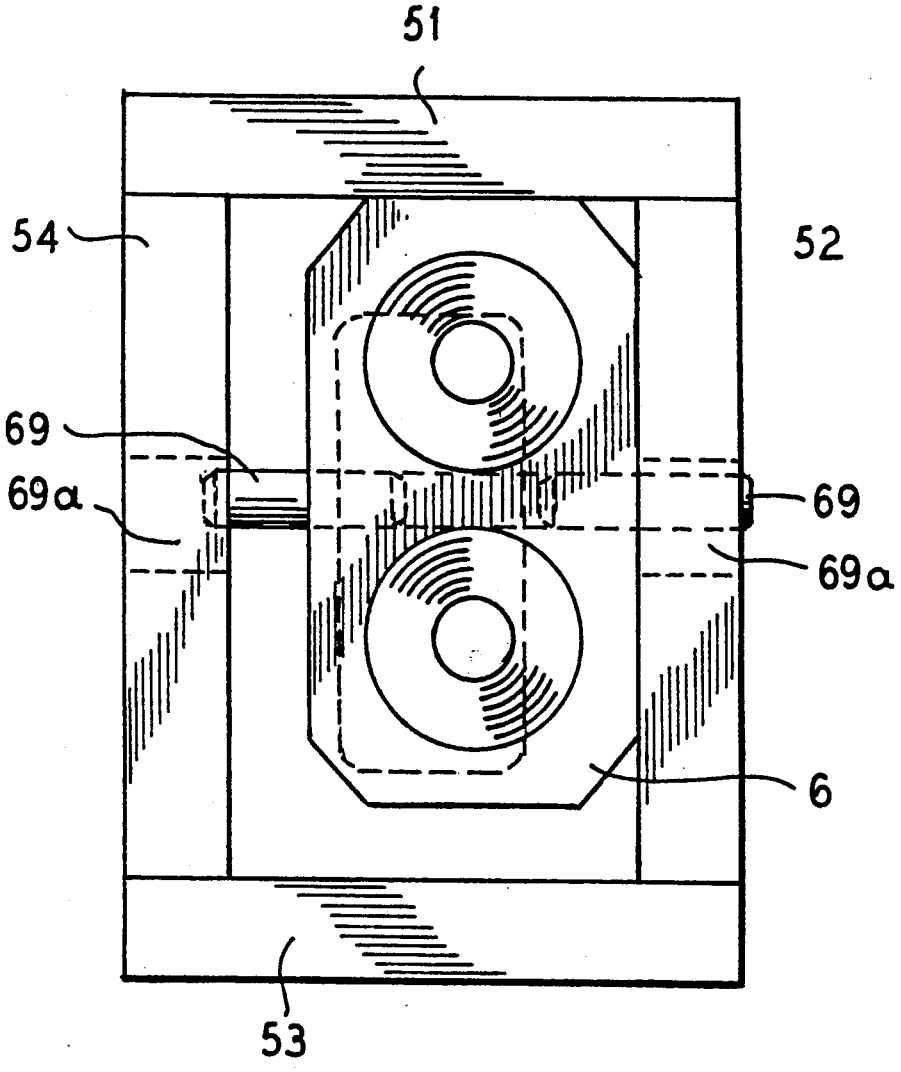
FIG. 2B is a top view taken in the direction of arrow D in FIG. 2A.
Figure 3A:
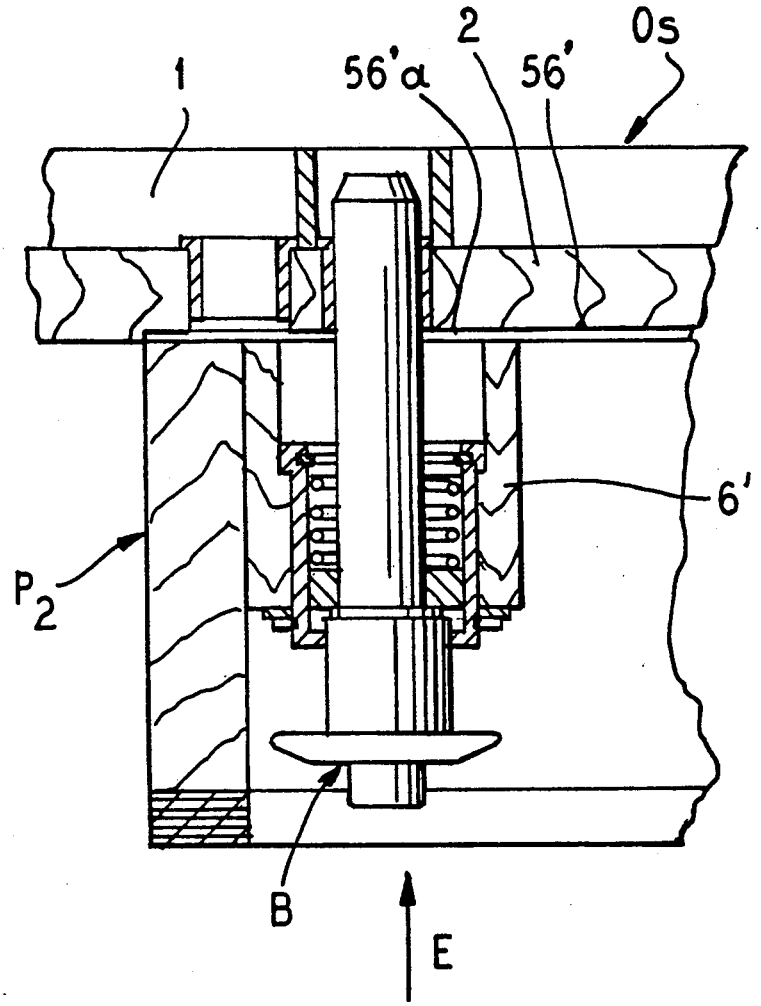
FIG. 3A is a partial cross sectional view of a modification of an arrangement for fastening the blank separating punch on the tool.

As illustrated in FIGS. 2A and 2B; a first punch P1 of a relatively small dimension is mounted on a lower side 2*b* of the plate 2. The punch P1 has the shape of a rectangle formed by a slightly extended block 5 which, as illustrated in FIG. 2B, includes side walls 51, 52, 53 and 54 which are assembled at their ends by means of glue and form a rectangle having a closed top formed by a fifth plate 55, which is glued to the edges of the plates 51–54. A surface of the plate 55 facing the surface 2*b* of the plate 2 is provided with a non-slipping coating or material of a high coefficient of friction 56, whereas the opposite edges of each of the plates 51–54, which will contact the blank, has a foam coverage or covering 67.

The interior of the punch P1 allows a freely insertion of a rectangular block 6 which is used for fastening the punch P1 on the lower plate 2. Two short cylindrical rods or pins 69 (FIG. 2B) are mounted in a corresponding hole in the block 6 and extend into oblong apertures 69*a* on two opposite plates 52 and 54 of the punch P1. The width of the two oblong apertures 69*a* is greater than the diameter of the rod 69. These rods 69 have, for the purpose to prevent the block 6 and the punch P1 from being separated from one another, but do allow relative horizontal and vertical shifting necessary for the positioning of the punch P1. The upper surface of the fastening block 6 which will be in contact with the lower surface of the plate 55 is provided with a non-slipping coverage or coating 61 which coacts with a coverage 57 on the plate 55.

The fastening block 6 is connected to the lower plate 2 by means of two self-locking pins B. Each of the pins B has a head 80 and a hollow rod 81, which at an end opposite the head 80 has two salient balls 82. The rod 81 receives a central sliding rod 83. The pin B can be unlocked by pressure exerted on the central rod 83, which allows the balls 82 to be retracted.

The fastening block 6 has a bore 161 which has a counterbore portion 161*a* forming an internal shoulder adjacent the side of the block 6 having the coating 61. Each of the bores 161 receives a bushing 62 which has a flange 62*a* at one end received in the counterbore 161*a*. At an opposite end from the flange 62*a*, the bushing receives a washer 64*e*, which is held in place by a snap ring 64*c*. The bushing 62 is closed at the end adjacent the flange 62*a* by a first washer 63 which is held in place by a snap ring 64*a*. A second washer 65 is easily slidably received within the bushing 62. In addition, a compression spring 66 is interposed between the two washers 63 and 65. Each of the washers 63 and 65 are provided with apertures that allow a rod 81 of the pin B to pass through. A shoulder 68 of the head 80 is supported by the second washer 65. The cylindrical part of the head 80 is able to penetrate into the bushing 62 and the head and balls 82 are to retain the pin B within the bushing 62, i.e., the block 6. The upper plate 55 of the block 5 has an aperture 55*a*, which is of a relatively large dimension and offers sufficient space for the passage of the rods 81.

FIG. 1A shows that it is appropriate, for fitting the punch P1, to have a lateral arrangement in the vicinity of the required area of the lower plate 2 and that they insert the two rods 81 through the bushings 21, it being understood that the distance between the axis of the two pins B is equal to twice the distance between the axes of two adjacent holes 20.

The assembly is, thus, designed so that the balls 82 of each pin B may be retained by shoulder-like stops 21*a* of the bushings 21 so as to prevent a downward displacement of the pin B. On the other hand, owing to the spring 66, there is a possibility to shift the punch P1 vertically away from the plate 2 and with the non-slipping coating, such as 56 having been released to allow repositioning the punch P1 with regard to the lower plate 2. If, on the contrary, it is desirable to remove the pin B, the central shaft or rod 83 of the pin is pushed to release the balls so that the rod 81 can be withdrawn from the bushing 21.

Since it is illustrated in FIG. 2A that the auxiliary apertures 12 are situated opposite the holes 20 of the board 2, which holes are not encompassed within the large rectangular apertures 10, the pins B can also be located in these particular areas.

Figure 3B:
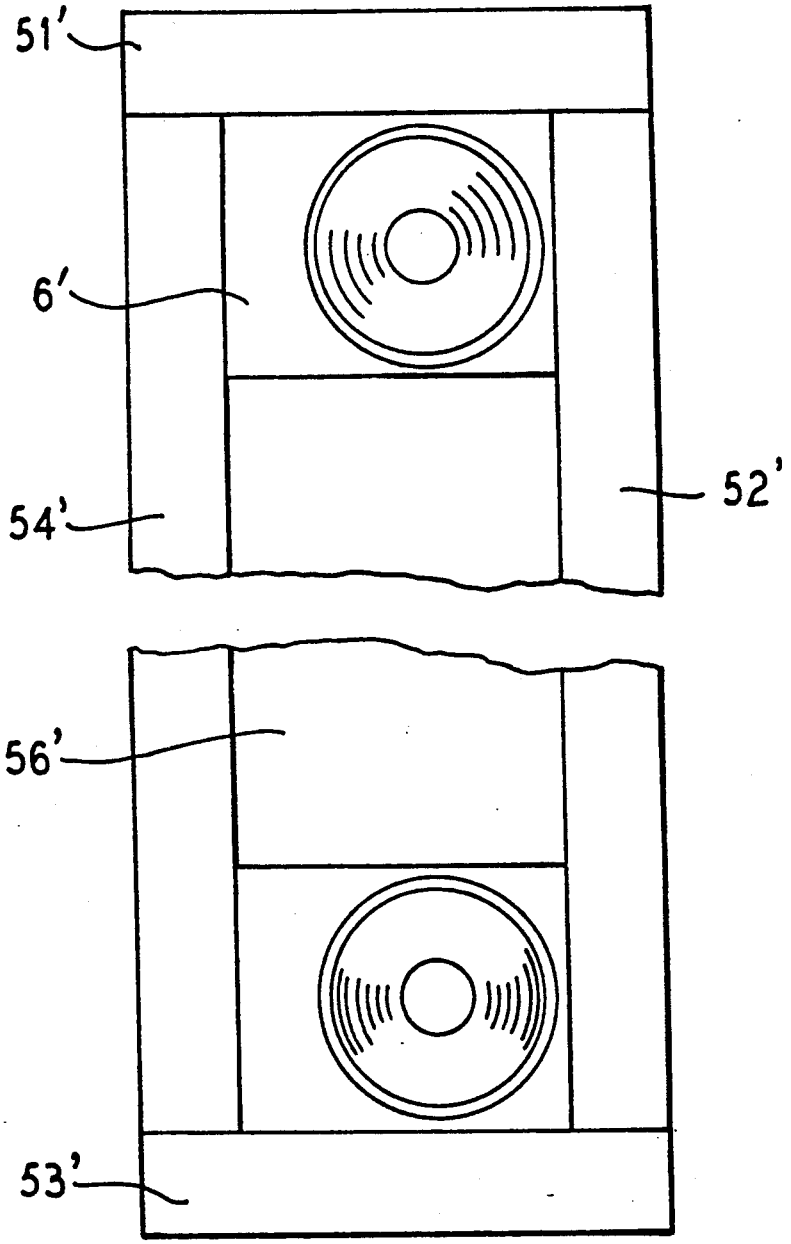
FIG. 3B is a top view taken in the direction of arrow E of FIG. 3A.

In accordance with the embodiment illustrated in FIGS. 3A and 3B, a punch P2 is of the same shape as the punch P1 of FIG. 2A, though of a larger dimension and is formed by plates 51', 52', 53' and 54'. On the one hand, the punch P2 has two blocks 6' which are smaller than the block 6 and each has only a single pin B. Moreover, the punch P2 has no upper plate, similar to the plate 55 of the punch P1, and is only provided with a non-slipping coating 56', which is provided with an aperture 56'*a* (FIG. 3A) to allow the rod 81 of the pin B to pass therethrough. Every block 6' is mounted on a punch P2 so as to allow the block to be shifted within an adequate range vertically and horizontally, one with regard to the other. Regarding further details, the function of the punch P2 is similar to that of P1. However, for some of the punches P2 it is also possible to envision the block 6' either fixed with regard to the punch P2 or else being an integral part of them.

Obviously, it is possible to envision other variations with regard to the dimensions and shapes of the punches P1 and P2.

Figure 1C:
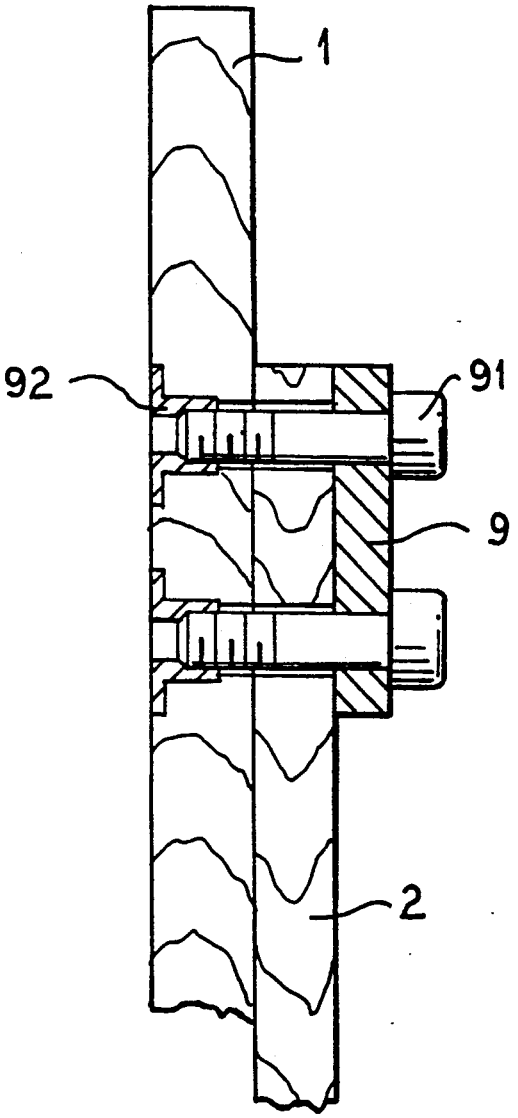
FIG. 1C is a partial cross sectional view taken along the lines B—B of FIG. 1A.
Figure 1D:
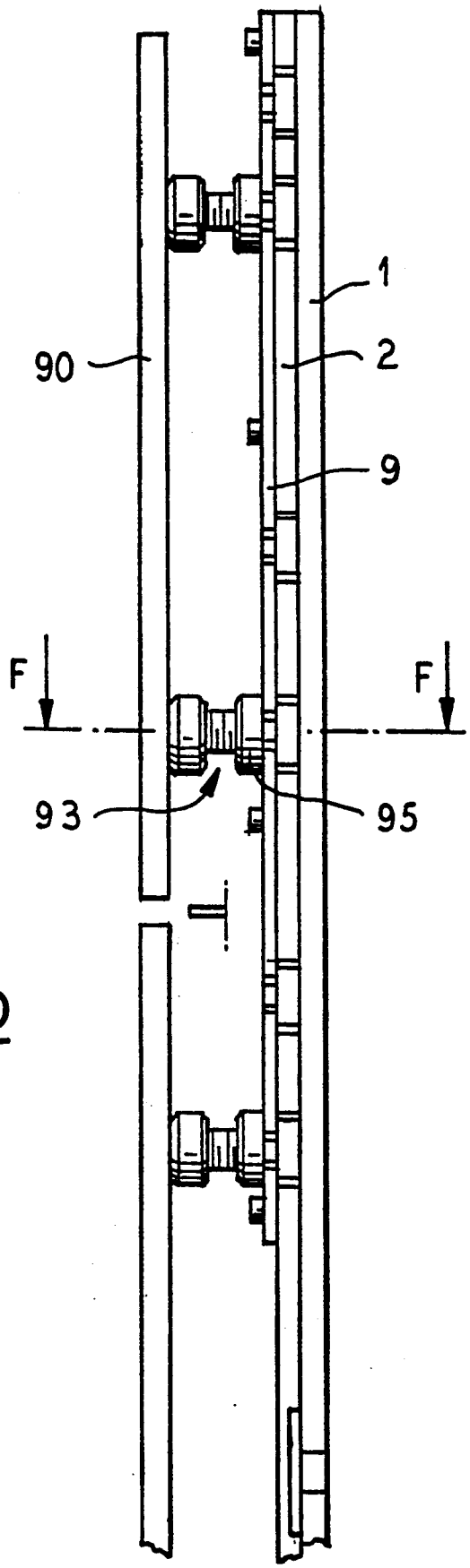
FIG. 1D is a side view taken in the direction of arrow C of FIG. 1A.
Figure 4:
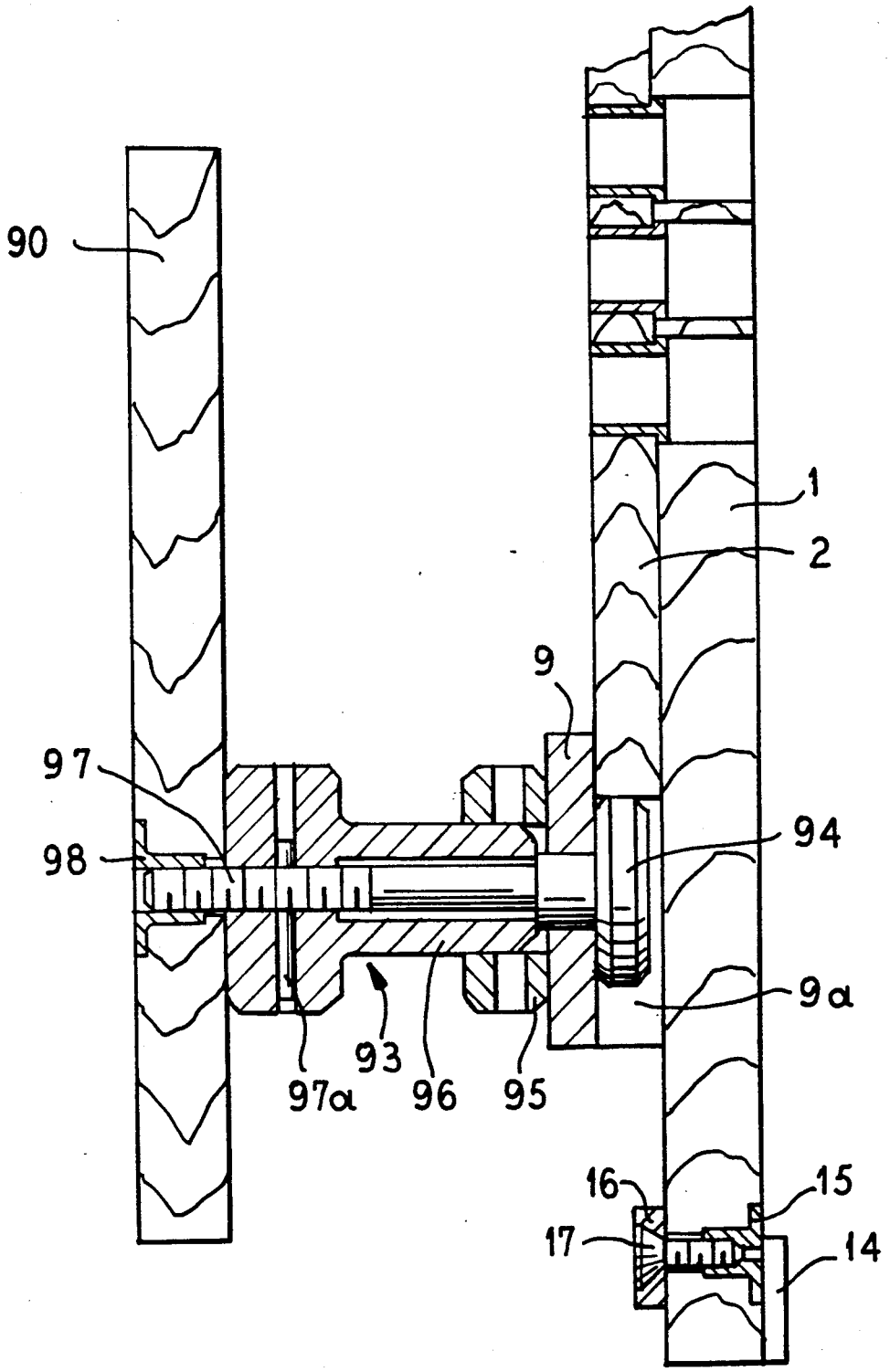
FIG. 4 is a cross sectional view taken along the lines F—F of FIG. 1D.

Referring to FIGS. 1A and 1C, the lower plate 2 is provided with a metal bar 9 along a leading edge of the plate. The metal bar 9 enables mounting two special punches 90 for the separation of the blank linked immediately with the front waste portion. Several screws 91 (FIG. 1C), each of which passes through the bar 9, and the lower plate 2 are engaged with threaded bushings 92, which are mounted or seated in the upper plate 1 to allow the fastening of the bar to the lower plate 2. Every special punch 90 (FIGS. 1D and 4) includes a body 96, a rod 99 passing through the body 96 and a nut 95 which is threaded on the outer threads of the body 96. The rod 99 has a head 94 which engages an upper surface of the bar 9. Proper placing of the head 94 is insured by several notches 9a situated along the edge of the bar. The rod 99 also includes threads 97 which engage corresponding internal threads of the body 96 and of a bushing 98, which is mounted in a special punch 90. A pin 97a prevents the rotation of the body 96 on the rod 99. Due to the appropriate rotation of the nut 95, the special punch 90 is definitely mounted with regard to the lower board 2.

The upper side of the front edge of the upper plate 1 will bear a first plate 14 mounted by means of two threaded bushings 15, a second little plate 16 situated on the side of the plate 1, and two screws 17. The little plate 14 allows the centering of the upper tool Os on a movable frame of the blank separating station.

The upper tool Os, which is described hereinabove can be used with almost all lower tools with adjustable dimensions known up to now. For instance, the one described in the above-mentioned U.S. Pat. No. 4,175,686.

Although various minor modifications may be suggested by those versed in the art, it should be understood that I wish to embody within the scope of the patent granted hereon all such modifications as reasonably and properly come within the scope of my contribution to the art.

I claim:

1. In a device for separating blanks formed in a sheet of material, which blanks will be subsequently formed into packages, said device comprising an upper vertical movable tool provided with several punches which are adjustably positioned on the upper tool and have adjustable dimensions and a lower fixed tool provided with several apertures corresponding in their position and dimensions to the punches so that the punches will push a blank through the apertures, the improvements comprising the upper tool comprising a first plate member having a plurality of holes being arranged in a pattern, each punch being provided with quick-locking means for pressing an upper surface of the punch under an elastic load against a lower surface of the first plate member, said quick-locking means including a first end engaged within the punch and a second end extending through a hole in said first plate member, and a second plate member being secured to an upper surface of the first plate member, said second plate member having enlarged apertures encompassing several holes in the first plate member and having separate openings aligned with other holes of the first plate member, which other holes are not encompassed by said apertures of the second plate member.

2. In a device according to claim 1, which includes a link between the punch and each quick-locking means to allow adjustably positioning the punch relative to the quick-locking means.

3. In a device according to claim 2, which includes a non-slipping coating being arranged between the lower surface of the first plate member and the upper surface of the punch.

4. In a device according to claim 1, which includes a layer of material having a high coefficient of friction being disposed between the lower surface of the first plate member and the upper surface of the punch.

5. In a device according to claim 1, wherein each punch consists of several plates assembled to form a polygonal enclosure, said enclosure being closed at one side by a closing element, said quick-locking means extending through an opening in said closing element which serves as a resting point for a portion of said quick-locking means.

6. In a device according to claim 1, which includes means for fastening a special punch for separating a front waste portion of the sheet from said blanks.

7. In a device according to claim 1, wherein a lower surface of each punch which contacts a blank is provided with a layer of foam material.

8. In a device for separating blanks formed in a sheet of material, which blanks will be subsequently formed into packages, said device comprising an upper vertical movable tool provided with several punches which are adjustably positioned on the upper tool and have adjustable dimensions and a lower fixed tool provided with several apertures corresponding in their position and dimensions to the punches so that the punches will push a blank through the apertures, the improvements comprising the upper tool comprising a plate member having a plurality of holes being arranged in a pattern, each punch being provided with quick-locking means for pressing an upper surface of the punch under an elastic load against a lower surface of the plate member, said quick-locking means including a first end engaged within the punch and a second end extending through a hole in said plate member, a non-slipping coating being arranged between the lower surface of the plate member and the upper surface of the punch, a link between the punch and each quick-locking means to allow adjustably positioning the punch relative to the quick-locking means, the quick-locking means including a self-locking pin having two balls retractably mounted at one end, said balls being movable to an engagement position by a central rod received in said pin, an auxiliary fastening block being mounted so as to be able to slide along the pin, a spring being arranged between a supporting point of the pin and a supporting point of said block so, with the pin in a locked position, a side of the fastening block will be able to obtain a support on a corresponding surface of the punch so as to elastically press the punch against the plate member, said fastening block and punch being fitted together by means which allow relative shifting movement therebetween.

9. In a device according to claim 8, wherein the fastening block is provided with a bore which receives a bushing, said bushing having a first and second washer disposed therein with said spring disposed therebetween, said first and second washers slidably receiving the pin which has a head with a shoulder engaging one of the two washers when the pin is in a fixed position joining the block to the plate member.

10. In a device according to claim 9, wherein a layer of material having a high coefficient of friction is arranged between the fastening block and the punch.

11. In a device according to claim 8, wherein the punch consists of several plates assembled together to form an open polygonal enclosure in which the quick-locking means is arranged, the enclosure being closed adjacent one side of the plates by a closure element serving as a rest point for the fastening block.

12. In a device according to claim 8, wherein the plate member, on a surface opposite the lower surface engaging the punches, has an upper plate member with a great number of larger apertures overlying several of the holes in the first-mentioned plate member, and said upper plate member having additional holes aligned with the non-encompassed holes of the first-mentioned plate member.

13. In a device according to claim 8, which includes means for fastening at least one special punch for separating blanks from a front waste portion of the sheet.

14. In a device according to claim 8, wherein a surface of each of the punches designed for contact with the blanks is provided with a layer of foam material.

15. In a device for separating blanks formed in a sheet of material, which blanks will be subsequently formed into packages, said device comprising an upper vertical movable tool provided with several punches which are adjustably positioned on the upper tool and have adjustable dimensions and a lower fixed tool provided with several apertures corresponding in their position and dimensions to the punches so that the punches will push a blank through the apertures, the improvements comprising the upper tool comprising a plate member having a plurality of holes being arranged in a pattern, each punch being provided with quick-locking means for pressing an upper surface of the punch under an elastic load against a lower surface of the plate member, said quick-locking means including a first end engaged within the punch and a second end extending through a hole in said plate member, a link between the punch and each quick-locking means to allow adjustably positioning the punch relative to the quick-locking means, the quick-locking means including a self-locking pin having a hollow shaft containing two balls at one end and receiving a central control rod urging the balls in an outer position for engaging an edge of an aperture, an auxiliary fastening block being mounted so as to be able to slide along the pin, spring means for supporting the pin in said auxiliary fastening block and allowing axial movement therebetween so that the pin, when in a locking position, allows the block and punch to be moved away from a lower surface of said plate member to allow adjusting the relative position of the punch and block relative to said plate member.

* * * * *